United States Patent [19]

Lautenschläger et al.

[11] Patent Number: 4,502,182

[45] **Date of Patent: * Mar. 5, 1985**

[54] OVER-CENTER HINGE

[75] Inventors: Karl Lautenschläger, Reinheim; Gerhard Lautenschläger, Brensbach-Wersau, both of Fed. Rep. of Germany

[73] Assignee: Karl Lautenschläger KG, Möbelbeschlagfabrik, Reinheim, Fed. Rep. of Germany

[ * ] Notice: The portion of the term of this patent subsequent to Dec. 27, 2000 has been disclaimed.

[21] Appl. No.: 416,549

[22] Filed: Sep. 10, 1982

[30] Foreign Application Priority Data*

Sep. 14, 1981 [DE] Fed. Rep. of Germany ..... 3136437
Jan. 20, 1982 [DE] Fed. Rep. of Germany ..... 3201570
May 15, 1982 [DE] Fed. Rep. of Germany ..... 3218435

[51] Int. Cl.[3] ..... E05F 1/12

[52] U.S. Cl. ..... 16/288; 16/291; 16/294; 16/333; 16/360; 16/371

[58] Field of Search ..... 16/255, 257, 284, 288, 16/291, 292, 293, 294, 296, 297, 303, 302, 321, 325, 333, 335, 347, 366, 368, 369, 370, 371, 374, 360, 379

[56] References Cited

U.S. PATENT DOCUMENTS

| | | | |
|---|---|---|---|
| 465,968 | 5/1914 | Autier | 16/366 |
| 4,187,580 | 2/1980 | Lautenschlager et al. | 16/333 |
| 4,319,382 | 3/1982 | Zernig | 16/365 X |
| 4,422,214 | 12/1983 | Lautenschlager | 16/291 |

*Primary Examiner*—Fred A. Silverberg

[57] ABSTRACT

An over-center self-closing hinge for furniture. In the door-related part of the hinge, which is in the form of a cup to be set in a mortise, there is provided a resiliently biased, pivotingly mounted cam which, in cooperation with a contact surface on the jamb-related part of the hinge, forms the over-center mechanism. Within the hinge cup there is provided a swivel arm which can be swung upwardly to a position in which it holds the resiliently biased cam in its dead-center position. With the swivel arm there is associated a resilient element which seeks to swing it up into the raised position. The resilient element is preferably an elastically flexible arm reaching beneath the swivel arm and joined fixedly to the cam adjacent the pivot axis thereof.

20 Claims, 14 Drawing Figures

FIG. 1
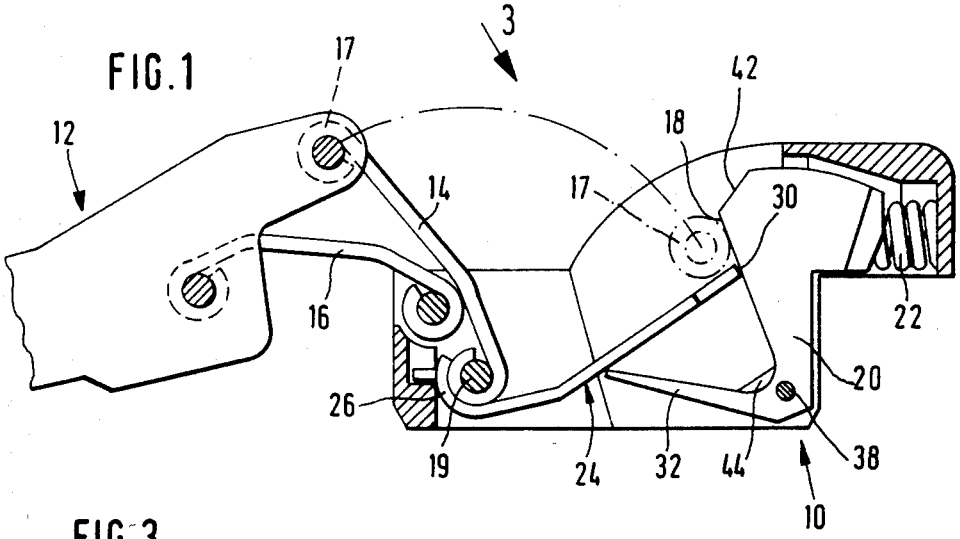
FIG. 3
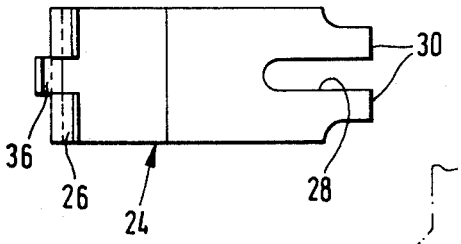
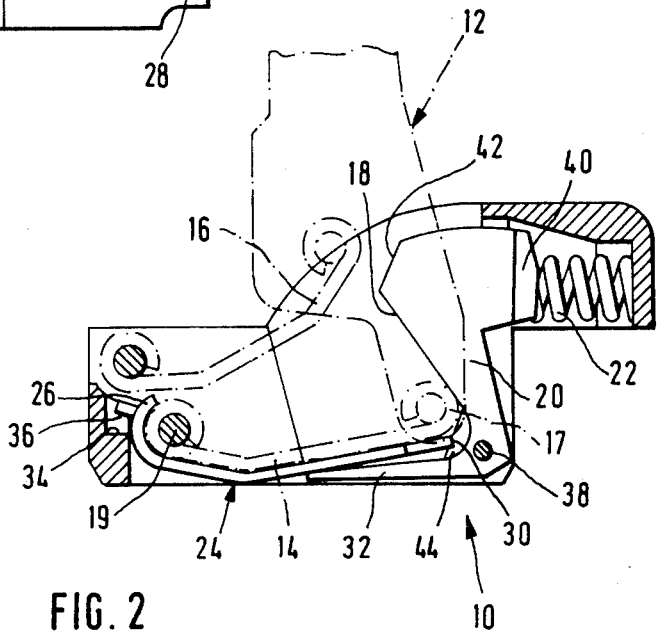
FIG. 2

OVER-CENTER HINGE

BACKGROUND OF THE INVENTION

The invention relates to an over-center hinge for cabinet doors having a door jamb-related part which can be fastened to the door jamb of a piece of furniture, and a door-related part made in the form of a recess-mounting cup joined by a linkage to the jamb-related part. The cup has in its circumferential wall, adjacent its bottom, a cam or tongue mounted for pivoting under the bias of a compression spring toward the interior of the cup by a certain angular amount; this cam has a cam surface sloping upwardly from the cup bottom from the outside toward the inside, on which surface a rider means provided adjacent the linkage end of the jamb-related part rides during a portion of the opening and closing movement between the hinge-closed position and a dead center position and forces the door to the closed position; a stop means in the form of a swivel arm pivoted inside of the hinge cup at a distance from the pivot axis of the cam or tongue, with its free end pointing toward the cam and terminating in a stop edge parallel to the pivot axis is made for pivoting from a position in which the stop edge is below the cam surface of the cam to a position in which the stop edge holds the cam precisely in its dead-center position.

A hinge of this kind is known from German Offenlegungsschrift No. 30 18 184 corresponding to U.S. patent application Ser. No. 261,472, filed May 7, 1981, now Pat. No. 4,422,214, which combines the simple, proven design and reliable operation of over-center hinges having a resilient cam in the hinge cup with an over-center characteristic which formerly could be achieved only by considerably more complex and therefore more expensive embodiments. In the known hinge, the automatic movement of the swivel arm to the dead-center position when the hinge is opened is accomplished by a driving mechanism which snap-fastens the swivel arm to one of the links of the linkage mechanism so as to carry it over the necessary distance. In the dead-center position, the swivel arm runs against an abutment in the hinge cup. As the opening movement of the hinge continues, the part of the link mechanism that carries the swivel arm with it is therefore unsnapped from the swivel arm, so that the latter stops precisely in the position in which its stop edge holds the cam in the position associated with the dead-center position of the over-center mechanism. Experiments have shown that this snap-catching of the swivel arm during the opening of the hinge functions perfectly during a great number of operations. Nevertheless, it is, of course, quite impossible to prevent wear on the surfaces of the snap mechanism which produce the snap-catching action, so that ultimately the swivel arm will no longer function with the necessary reliability.

It is the object of the invention to improve the known hinge such that it can operate without the gripping or snap-catching mechanism that operates the swivel arm to hold the tongue or cam in the dead-center position when the hinge is opened.

BRIEF SUMMARY OF THE INVENTION

Setting out from a hinge of the kind described above, this object is achieved in accordance with the invention by providing within the hinge cup a resilient element engaging the swivel arm under bias and seeking to shift the swivel arm to the position in which it locks the cam in the dead-center position. When the hinge is opened, the swivel arm then is shifted by the biased resilient element to the position in which it locks the cam in the dead-center position, without the need for catching or gripping it.

The resilient element is preferably an elastically flexible arm joined to the cam adjacent its journal in the hinge cup. Its free end engages the swivel arm, i.e., the spring used is a straight spring or flat spring, which is especially suitable for the application involved on account of the small amount of space it requires in the interior of the hinge cup.

In the linkage mechanism of the hinge of the invention is formed by two hinge links whose ends are pivoted in the manner of a trapezoid in the hinge cup at one end and on the jamb-related hinge part at the other, it is desirable to use as the swivel arm a flat piece stamped from sheet metal whose end opposite the stop edge is arcuately bent and mounted for pivoting on the pivot eye of the hinge link which lies in the bottom part of the hinge cup when the hinge is in the closed state.

It is then desirable to stamp a tab out of the arcuately bent end of the hinge link and bend it up towards the adjacent wall of the hinge cup, and to form in the wall of the hinge cup an associated abutment to be engaged by the tab when the swivel arm is in the position in which it locks the cam in the dead-center position.

BRIEF DESCRIPTION OF THE DRAWING

The invention will be further explained in the description that follows of several embodiments, in conjunction with the drawing, wherein:

FIG. 1 is a cross-sectional elevational view through the recess-mounting cup of a first embodiment of a hinge of the invention, the front end of the corresponding jamb-related hinge part being shown in the wholly opened position, FIG. 2 is a cross-sectional elevational view through the hinge cup shown in FIG. 1, in which the jamb-related part is shown in broken lines in the closed state;

FIG. 3 is a top view of a swivel arm disposed in the hinge cup as seen in the direction of arrow 3 of FIG. 1.

DETAILED DESCRIPTION OF PREFERRED EMBODIMENTS

Figure 4:
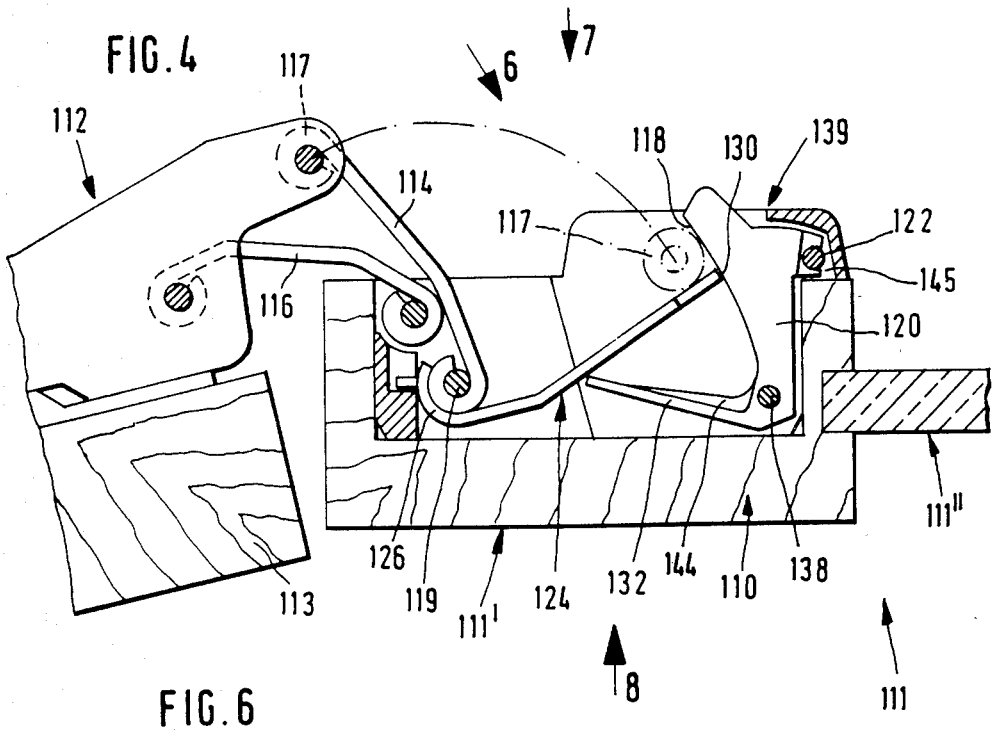
FIG. 4 is a cross-sectional view through the hinge cup of a second embodiment of a hinge in accordance with the invention, which is fastened to the inside surface of the frame, the front end of the corresponding jamb-related hinge part being again shown in the fully opened position.
Figure 6:
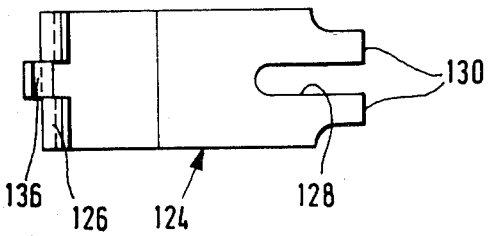
FIG. 6 is a top view of a swivel arm disposed in the hinge cup, as seen in the direction of arrow 6 in FIG. 4.
Figure 5:
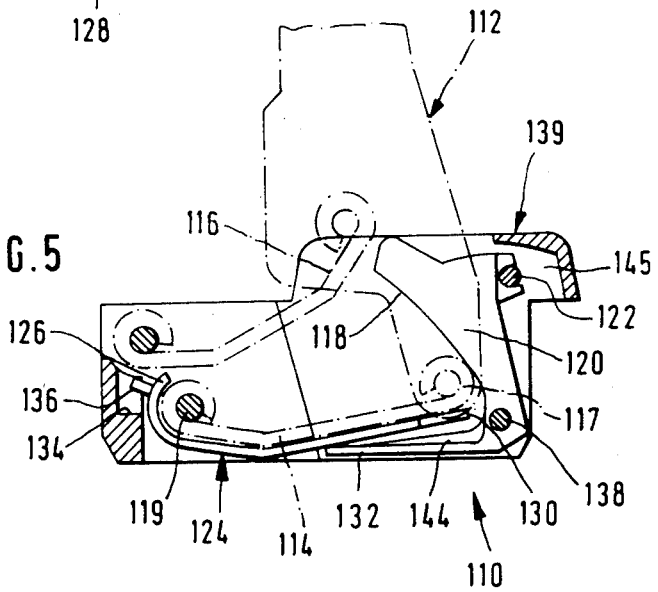
FIG. 5 is a cross-sectional view through the hinge cup shown in FIG. 4, the jamb-related hinge part being represented in the closed position in broken lines.

FIGS. 1 and 2 represent the recess-mounting cup 10 of the door-related part of an over-center, self-closing hinge designed for the mounting of a door on a cabinet. FIG. 1 shows a portion of the jamb-related part of the hinge in the form of an elongated supporting arm 12, and the hinge links 14 and 16 which pivot on the supporting arm 12 and on the hinge cup 10, respectively, and constitute the hinge articulation. It can easily be seen that, when the hinge cup 10, and with it the door, is swung from the open position represented in FIG. 1 to the closed position shown in FIG. 2, the eye 17 of the link 14 will run against the downwardly sloping face 18 of the cam 20 which is pivoted in an opening in the wall of the hinge cup 10 and which is biased by a spring 22 toward the interior thereof to the position in which it is held by abutting against the raised free end of a swivel arm 24. The opposite end 26 of this swivel arm 24 (FIG. 3), which is stamped out of sheet metal, is curled about the pivot eye at which the link 14 is mounted in the hinge cup 10, so that its right edge 30, interrupted by a short notch 28, can be moved between the end positions represented in FIGS. 1 and 2. The edge 30 constitutes an abutment for holding the cam 20 in the position represented in FIG. 1.

This set position is precisely the dead-center position, i.e., the position in which the cam 20 is forced back against the bias of spring 22 as far as it will go. In the closing movement, therefore, the eye 17 of link 14 will run against the edge 18 of the cam 20, as indicated in FIG. 1 by an additional representation in broken lines of the eye 17.

As the closing movement continues, the link 14 presses against the swivel arm 24 and carries it along towards the bottom of the hinge cup 10. The edge 30 thus releases the cam 20 and the cam edge 18 presses against the eye 17 to produce a component of the force stored in spring 22 which acts in the hinge-closing direction. That is to say, immediately after the eye 17 moves in the closing direction past the dead-center position at which it can arrive without effort, a closing pressure acts upon it which causes the hinge to snap to the closed position and holds it under bias in the closed position (FIG. 2).

An elastically flexible arm 32 is integral with the bottom end of the cam 20, i.e., in the area of its pivot in the hinge cup 10, and it reaches underneath the swivel arm and engages with slight bias the bottom of the swivel arm 24, i.e., seeks to swing the swivel arm upward to engage cam 20 in its dead-center position, as shown in FIG. 1. Since the spring force exercised by the arm 32 on the swivel arm 24, however, is considerably less than the holding force exercised by the cam on the pivot eye 17, the closing action of the hinge is not impaired by the bias exercised by arm 32 on the swivel arm 24.

In the opening movement, the eye 17 of hinge link 14 slides upwardly on the edge 18 of the cam 20 and forces it back with additional compression of the spring 22 until the dead-center position is reached, while at the same time the free end of resilient arm 32 swings upwardly. Under the action of the bias increasingly exercised by arm 32 on the swivel arm 24, the latter accompanies the hinge link 14 until the abutment edge 30 holds the cam 20 in the dead center position. Any further turning of the swivel arm 24 is then prevented by stop means on the lever and in the hinge cup. For the creation of these stop means, an abutment 34 is formed inside of the hinge cup 12 adjacent the pivot of the hinge link. This abutment is encountered by a tab 36 cut and bent up from the end 26 of swivel arm 24 when the dead-center position is reached. Since no further movement of the swivel arm 24 out of the hinge cup is possible, the eye 17 of link 14 comes away from the face 18 of the cam as movement continues in the opening direction, and the hinge can be swung all the way to the open position without any further application of force by the over-center mechanism.

The cam 20, which turns on a pivot 38 fitted through a bore in the hinge cup 10 and a bore in its lower end, is limited in its turning movement by stops 40 (FIG. 2) and associated abutments (not shown) in the hinge cup 10, so that it cannot be turned all the way into the cup interior by the spring 22 even when swivel arm 24 is forced toward the bottom of the hinge cup and its edge 30 is then below the face 18 of the cam and can no longer hold it in the dead-center position. If this has happened accidentally and the cam therefore is forced by spring 22 a little further into the interior of the cup 10, it will suffice to press against the upper end of the cam against its bias to bring the swivel arm 24 back to the dead-center position, since the turning movement of the cam 20 is transmitted by the resilient arm 32 to the bottom of the swivel arm 24. On the other hand, the above-described manipulation of the cam 20 is not absolutely necessary, because it is provided on its upper end with a face 42 which slopes rearwardly upward. In the next subsequent closing of the hinge, this surface is engaged by the eye 17 and the cam 20 is forced back until the eye then passes over onto the face 18. Thus the same effect is achieved as by the manual forcing back of the cam 20 and the next time the hinge is opened, the hinge will again be fully operative.

The gap 28 interrupting the edge 30 of the swivel arm 24 accommodates a reinforcing rib 44 which stabilizes the transition between the bottom end of the cam 20 and the flexible arm 32 when the hinge is closed. Also, it prevents wear on the face 18 of cam 20 in a central area corresponding to the width of the gap 28 by the edge of the swivel arm 24, thus forestalling progressive weakening in the course of time of the closing torque exercised by cam 20 on pivot eye 17.

As an alternative to the above-described one-piece arrangement of cam 20 with the elastically flexible element 32 which biases the swivel arm, the flexible element can also be constituted by a separate spring, i.e., one made separate from the cam 20. For example, it is possible to use a two-legged spring whose one leg is supported in the hinge cup 10 while the second leg urges the flexible arm 32 against the bottom of the swivel arm 24. Such a two-legged spring, which due to the small amount of bias needed requires only a small number of turns in its core, can be installed laterally adjacent the cam 20 on its pivot pin 38 or also laterally next to the hinge link 14 on its pivot 19. Also possible is the arrangement of a resilient tongue on the bottom of the hinge cup 10 or the formation of such a resilient tongue out of the bottom of the cup 10 itself. It is important in each case only that a bias acts on the swivel arm 24, seeking to turn it to the dead-center position.

If the hinge of the invention is to be used on cabinets for the mounting of glass doors having narrow, wooden frames, difficulties arise if the compression spring biasing the cam is a coil spring, because, on account of its size, the coil spring has to be contained within a hollow projection of the hinge cup, this projection extending considerably beyond the cup. Thus, if the door frame is narrow, this projection would extend beyond the frame and be visible through the glass even when the door is closed, which of course is unacceptable. In such applications, as well as others in which it is important that the hinge cup be very compact, a modified embodiment is advantageous which is characterized by the fact that the hinge cup has a flat fastening flange which projects from opposite sides of the cup parallel to the axis of movement of the hinge, and can be fastened to the inner face of the door. This flange has on its face confronting the door face a recess extending substantially over its entire length. In this recess the compression spring is contained in the form of an elongated, rod-like spring of metal held at its extremities, with the cam engaging its middle portion which lies exposed in the recess. On account of the fastening flange extending laterally from opposite sides of the hinge cup, it is possible for the recess provided for the rod-like spring, and for the spring itself, therefore, to be made relatively long, so that the flexing of its middle portion by movements of the cam is relatively slight in comparison to its length, such that the increase of the spring bias during each hinge action will be slight, which is favorable to the life of the spring. On account of the fastening flange, the dimensions of the hinge cup are also increased, but the flange projects beyond the hinge cup on opposite sides parallel to the axis of the hinge movement, i.e., the overreaching portions of the flange are concealed by the frame member that is parallel thereto.

The spring is constituted in the simplest case by a piece of steel spring wire or a flat steel spring which in the unbiased state is substantially rectilinear or only slightly curved.

The spring force can be increased by providing two parallel rod-like springs directly side by side in the recess in the mounting flange, thus reducing the stress on each spring.

The swivel arm, which is made by stamping from sheet metal, is provided with its fulcrum by bending its fulcrum end partially around one eye of the outer hinge link at the door end thereof. To hold the swivel arm at the dead-center position, a tab is cut and bent out of its curled end so as to run against an abutment in the wall of the hinge cup when the swivel arm is in the dead-center position. This mounting of the swivel arm has proven quite functional, but space must be provided in the hinge cup for the curled end of the swivel arm, and the hinge cup must have sufficient wall thickness in that area to form the abutment for the tab.

Less space is required in the hinge cup by a swivel arm fulcrum in which the pivot eye of the hinge link closer to the bottom of the hinge cup in the closed state has a portion cut away to expose its associated pivot pin. The swivel arm has a tab at its fulcrum end which is rolled to form a pivot eye, and this rolled eye is attached to the pivot pin within the cut-away eye of the hinge link. Since the swivel arm is thus fulcrumed directly on the hinge link pin, the free space required in the hinge cup can be reduced by an amount corresponding to the thickness of the material of the swivel arm.

The embodiment of a hinge in accordance with the invention which will now be described in conjunction with FIGS. 4, 5, 7 and 8, serves for the mounting of a door 111 on the door jamb 113 of a cabinet, the door consisting of a frame 111' holding a pane of glass 111''. For this kind of application, an especially compact design of the hinge cup 110 is required, which will be further explained below. Since the over-center mechanism is of basically the same operation and construction as the one described above, this mechanism will not be described in detail, inasmuch as parts of the hinge cup 110 which are functionally the same as those of cup 10 are designated with the same reference numbers preceded by "1".

The cam 120, which again in this case is pivoted on a pin 138 passing through a bore in its bottom end and held in aligned bores in the hinge cup 110, is biased toward the interior of the cup, not by a coil spring but by a straight spring 122 in the form of a piece of steel spring wire 122. The shape and arrangement of the steel spring wire can be seen in FIG. 8 which is a bottom view of the hinge cup 110. The hinge cup, which in the prior-art manner is of cylindrical shape and set in a mating cylindrical mortise in the frame 111', is provided with a planar fastening flange 139 which can be fastened flat against the inner face of the frame 111', and which extends from opposite sides of the cup parallel to the axis of rotation of the hinge (see also FIG. 7). On the side of this flange remote from the supporting arm 112, the flange extends beyond the circumference of the hinge cup 110 only to such an extent as to be able to accommodate the spring 122 and provide enough room for it to flex by the movement of the cam 120 abutting against it. The hinge cup therefore occupies a much narrower portion of the frame member than cup 10, in which the compressed coil spring 22 is used instead of the length of spring wire, and the coil spring must be housed in a hollow projection extending from the cup by a distance corresponding to its length, as well as being higher on account of the greater diameter of the coil spring. The hinge provided with the recess-mounted cup 110 made in the manner of the invention is therefore especially suitable for doors 111 of the kind represented in FIGS. 4 and 7, having a narrow frame 111', although it is also usable, of course, for doors made of solid board material.

The fastening flange 139 has a countersunk bore 141 in each of its ends (FIG. 8) for mounting screws 143 (FIG. 7) by which the hinge cup 110 is fastened to the frame 111'. The recess 145 extends over substantially the full width of the flange 139 and has at its extremities the sockets 145' for receiving the ends of the wire spring 122. Therefore a relatively long wire spring 122 can be used, i.e., the flexing of the spring by movements of the cam 120 is relatively slight with respect to its length, resulting in only moderate changes in the spring tension. These moderate tension changes, plus the fact that the cam is locked in the dead-center position by the swivel arm 124 and accordingly the number of rocking movements of the cam is half that of an over-center mechanism without the swivel arm 124, achieve the result that the over-center mechanism of the hinge constructed in the manner of the invention has a long useful life despite its amazingly simple construction.

The slot 128 interrupting the edge 130 of the swivel arm 124 permits on the one hand the entry of a reinforcing rib 144 stabilizing the transition between the bottom end of the cam 120 and the flexible arm 132, when the hinge is closed, and on the other hand it prevents the edge 130 of the swivel arm 124 from wearing down the face 118 of the cam 120 in a central portion corresponding to the width of slot 128. Consequently, there is no need to fear any slacking off, in the course of time, of the closing torque exercised by the cam 120 on the eye 117 of the hinge link 114.

Figure 9:
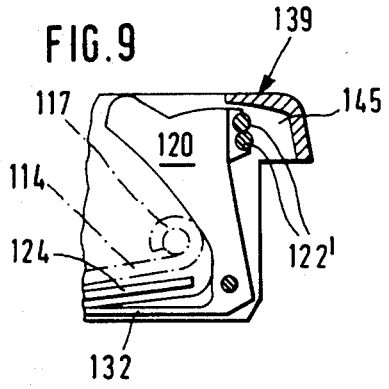
FIG. 9 is a partial cross section corresponding in location to FIG. 5, of the hinge cup of a modified embodiment of a hinge shown in FIGS. 4 to 8.
Figure 10:
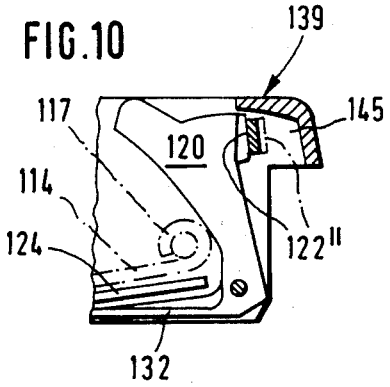
FIG. 10 is a partial cross section corresponding to FIG. 9 of another modified embodiment of the hinge.
Figure 7:
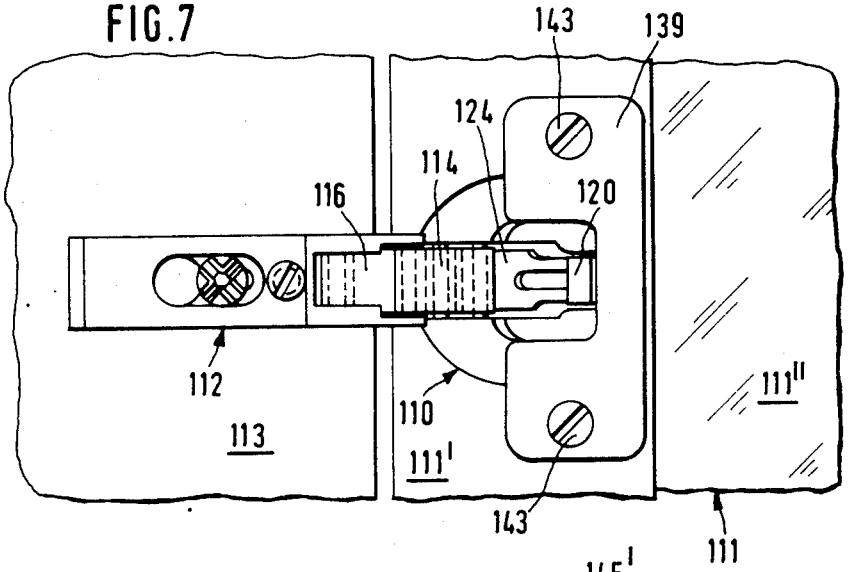
FIG. 7 is a top view of the hinge as seen in the direction of the arrow 7 in FIG. 4.
Figure 8:
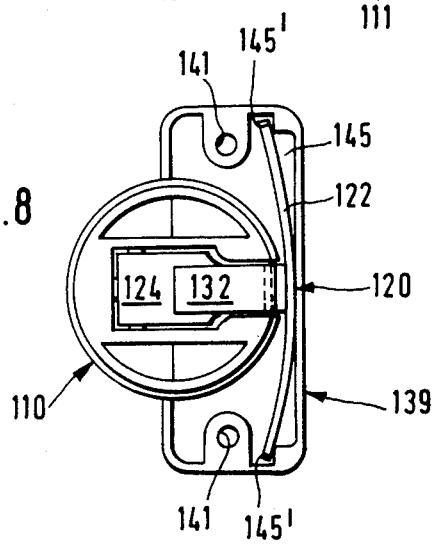
FIG. 8 is a bottom view of the hinge cup, as seen in the direction of the arrow 8 in FIG. 4.

FIGS. 9 and 10 show possible modifications of the construction and arrangement of the spring acting on the cam.

In FIG. 9, instead of the single piece of spring wire 122 used in the embodiment described above, two pieces 122' of such wire are used, one above the other, to provide a correspondingly greater holding force with less bias in each wire than in the case of the single spring wire 122'.

In the embodiment shown in FIG. 10, however, a flat spring 122" is provided, whose bias can be increased by placing a second flat spring 122" beside it, as indicated in broken lines.

To lock the swivel arm in the dead-center position of the cam, the construction, in a preferred development of the invention, is advantageously made such that the cam-holding edge at the free end of the swivel arm has a slightly lesser width than the cam, and on each side of the arm a short tab projecting beyond the edge is provided. The width of the cam face is reduced to the length of the cam-holding edge by lateral bevels extending over the length of the swing of the swivel arm. The upper end of each of the lateral bevels in the face of the cam then forms an abutment cooperating with each of the tabs projecting from the end of the swivel arm, such that the tabs will engage them precisely when they reach the dead-center position of the cam. Since the stop means for retaining the swivel arm in the dead-center position is now formed on the free end of the swivel arm, the formerly needed abutment in the wall of the hinge cup is eliminated. The hinge cup wall can accordingly be thinner in this area, and this permits a reduction of the diameter of the hinge cup.

Moreover, the dead-center position is precisely defined by the abutments at the ends of the bevels in the cam face so that the edge at the end of the swivel arm locks the cam precisely in the dead-center position every time. In comparison with the tabs provided at the fulcrum ends of the swivel arm and cooperating with an abutment on the hinge casing, a considerably more accurate locking of the cam in the dead-center position is achieved.

An increase in the bending resistance of the flexible arm and hence the exercising of a stronger bias on the cam can be produced by cutting a slot extending over a portion of the length of the swivel arm towards its fulcrum end to accommodate a raised rib provided on the upper side of the flexible arm facing the hinge links.

The resiliently flexible arm and the cam, as well as the rib, if any, are desirably made integral by injection molding from plastic.

Another embodiment that is a modification of the hinge described above in conjunction with FIGS. 4 to 10 is represented in FIGS. 11 to 14. Since in this case, too, the construction and operation of the over-center mechanism disposed in the hinge cup 210 is the same as in the embodiments described above, functionally equal parts are again provided with the same reference numbers, preceded by a "2", and only the special modifications will be described hereinbelow.

The swivel arm 224 made from sheet metal (FIG. 13) is not rolled at its fulcrum end about the eye on which the hinge link 214 is mounted in the hinge cup 210, but is pivoted on the same pin 219 on which the eye 221 of hinge link 214 is journaled. Instead, a middle portion of the eye 221 is cut away so that it has the gap 223 represented in FIG. 14, in which a portion of the pin 219 is exposed, around which an eye 226 on the end of the swivel arm 224 is rolled. The fulcrum eye 226 of swivel arm is rolled from a lug integrally formed in the stamping of the lever, corresponding in width to the approximate with of the gap 223. The right end of the swivel arm 224, as represented in the drawing, is thus able to swing between the end positions represented in FIGS. 11 and 12, and its edge 230 engages the face 218 of the cam 220.

The edge 230 of the swivel arm 224 has in this case a slightly lesser width than the cam 220 and at each end of the edge a short tab 234 projects beyond the edge toward the cam 220. These tabs are associated with lateral bevels 230 provided on the rocker, which extend over the length of the swing of the swivel arm 224. The width of the face 218 of the cam 220 is thus reduced in the range of movement of the swivel arm 224 to the width of the edge 230.

Figure 11:
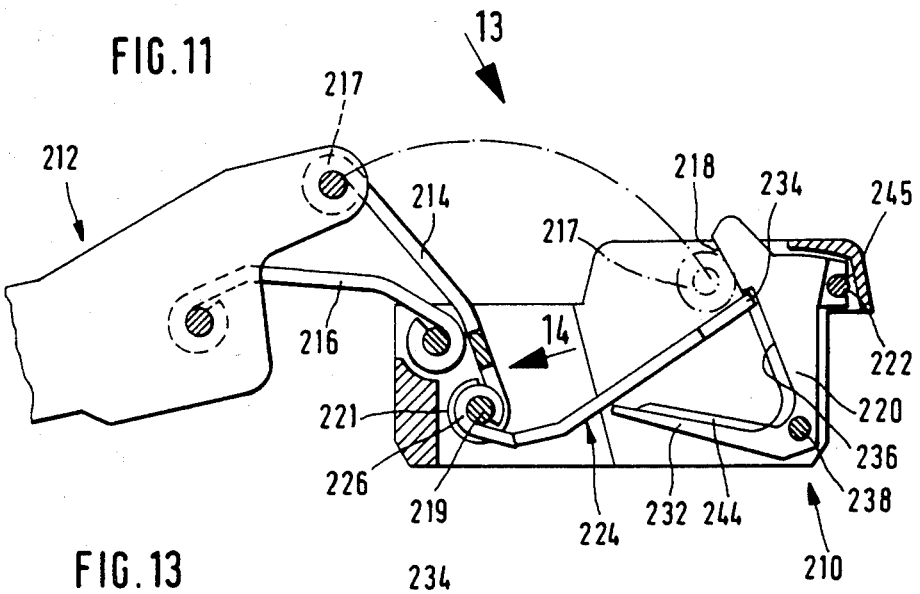
FIG. 11 is a cross section through the hinge cup of an additional embodiment of a hinge of the invention, in which the front end of the corresponding jamb-related hinge part is shown in the fully open position.
Figure 13:
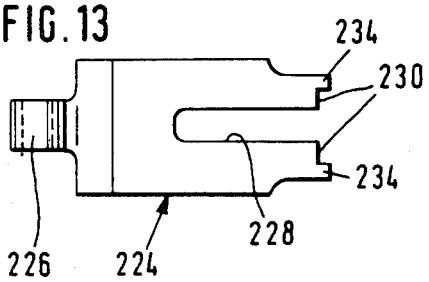
FIG. 13 is a top view of the swivel arm disposed in the hinge cup, as seen in the direction of arrow 13 in FIG. 11.
Figure 14:
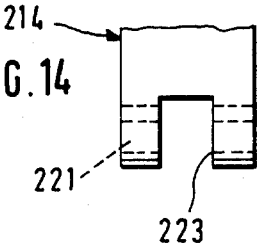
FIG. 14 is a view of the end of the hinge links joining the hinge cup to the jamb-related hinge part, as seen in the direction of the arrow 14 in FIG. 11.
Figure 12:
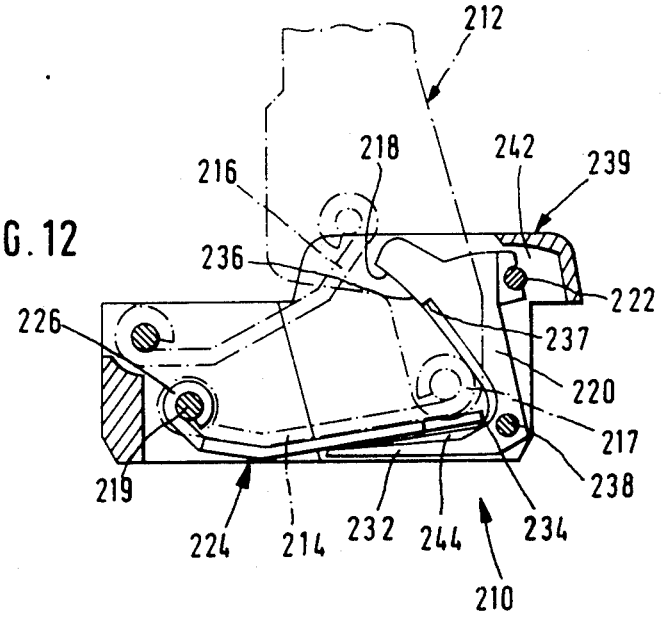
FIG. 12 is a cross-sectional view corresponding to FIG. 11, taken through the hinge cup, the jamb-related hinge part being represented in broken lines in the closed position.

In the opening movement of the hinge, the eye 217 of hinge link 214 slides from the closed position shown in FIG. 12 to the open position of FIG. 11 along the face 218 of the cam 220, and forces the latter back with additional compression of the spring 222 until the dead-center position is reached, while at the same time the free end of the flexible arm 232 swings upward. Under the action of the force increasingly applied by the arm 232 to the swivel arm 224, the latter follows the hinge link 214 until its projections 234 running in the lateral bevels 236 of the cam encounter the abutments 237 at the top of the cam. Since this is the case precisely when the cam 220 is in the dead-center position, and no further movement of the swivel arm 224 outwardly from the cup is possible, the eye 217 of the hinge link 214 comes away from cam face 218 as movement continues in the opening direction. The hinge can then be swung all the way open without any application of force by the over-center mechanism.

We claim:

1. Over-center hinge for cabinet doors, having a jamb-related part which can be fastened to a door jamb of a cabinet, and a door-related part in the form of a recess-mounting cup to be fastened in a door of a cabinet, and a linkage mechanism joining said cup to the jamb-related part and having a linkage end and being movable from a closed position to an open position through a dead-center position and vice versa, a cam mounted in said cup for pivoting by a given angular amount about a pivot axis, a compression spring biasing said cam toward the cup interior, a contact surface provided in the area of the linkage end of the jamb-related hinge part and sliding on a profile surface of said cam which extends slantingly from a bottom area of the cup into the interior of the cup, during a portion of the movement between the closed position and the dead-center position, and forces the door to said closed position, a stop element in the form of a swivel arm fulcrumed within the cup in the area opposite the pivot axis of the cam and having a free end pointing toward the cam, said swivel arm terminating in a stop edge disposed parallel to the pivot axis and swingable upwardly in the interior of the cup, from a position in which the stop edge is below said profile surface to a position in which the stop edge holds the cam precisely in said dead-center position, in the interior of the cup there being provided a resilient element engaging said swivel arm under bias, said element urging said swivel arm into the position locking the cam in the dead-center position.

2. Over-center hinge according to claim 1, wherein said resilient element is an elastically flexible arm joined to the cam adjacent the pivot axis in the hinge cap, said flexible arm having a free end engaging the swivel arm.

3. Over-center hinge according to claim 2, having a linkage mechanism formed by two hinge links having ends pivoted in the manner of a parallelogram about pivot pins in the hinge cup and on the jamb-related part, said swivel arm being a flat piece stamped from sheet metal having an end opposite said stop edge, which end is arcuately curled at the pivot pin of the hinge link which lies nearer the bottom area of the hinge cup when the hinge is in said closed position.

4. Over-center hinge according to claim 3, wherein a tab is cut from the arcuately curled end of the swivel arm and bent toward an adjacent wall of the hinge cup, and wherein in said wall of the hinge cup an abutment is formed, against which the tab lies in the position of the swivel arm in which the swivel arm locks the cam in the dead-center position.

5. Over-center hinge according to claim 3 or 4, wherein said stop edge of the swivel arm is interrupted approximately centrally by a slot cut out of the swivel arm.

6. Over-center hinge according to claim 5, wherein in an area of the cam between a lower end of the cam and the resilient arm, a reinforcing rib is provided which engages the slot in the swivel arm when the hinge is in its closed position.

7. Over-center hinge according to claim 6, wherein said resiliently flexible arm, said cam, and said reinforcing rib form an injection-molded, integral plastic piece.

8. Over-center hinge according to any one of claims 2 to 4, wherein said resiliently flexible arm and said cam form an injection-molded, integral plastic piece.

9. Over-center hinge according to claim 3, comprising a pivot eye at the door-related end of the hinge link nearer the bottom area of the hinge cup, said pivot eye in the closed position having a gap exposing a section of an associated pivot pin, said swivel arm having an end opposite said stop edge engaging the cam, a cut projection rolled to form another pivot eye, said other pivot eye encircling said section.

10. Over-center hinge according to claim 9, wherein said stop edge of the swivel arm has a slightly smaller width than the cam and a short lug projecting beyond the stop edge is cut on each side next to the stop edge, and wherein the width of the cam in the area of the profile surface is reduced over the length of the swing range of the swivel arm by lateral bevels, to the width of the stop edge or slightly less.

11. Over-center hinge according to claim 10 wherein step surfaces formed in the cam at the upper end of the lateral bevels form each an abutment surface cooperating with one of the lugs cut on the swivel arm, which abutment surfaces are engaged by the lugs when, in the opening movement the hinge reaches the dead-center position.

12. Over-center hinge according to any one of claims 9 to 11, wherein said stop edge of the swivel arm is interrupted approximately centrally by a slot cut from the swivel arm and extending over a portion of the length of the swivel arm in the direction of its end provided with the rolled other pivot eye, and wherein on the upper side of the flexible arm facing the swivel arm there is formed a rib fitting into the slot.

13. Over-center hinge according to claim 12, wherein said flexible arm, said cam and said rib form an injection-molded, integral plastic piece.

14. Over-center hinge according to any one of claims 9 to 11, wherein said elastically flexible arm and said cam form an injection-molded, integral plastic piece.

15. Over-center hinge according to claim 1, wherein said hinge cup has a flat fastening flange projecting from opposite sides parallel to the hinge pivot axis, and adapted to be fastened on the inside surface of the door, said flange having a bottom confronting an inside surface of the door with a recess extending substantially over the entire length of the fastening flange, in which recess said compression spring is disposed in the form of at least one elongated rod-like spring of spring-elastic metal held at ends thereof, and against a central portion thereof exposed in the recess said cam thrusts.

16. Over-center hinge according to claim 15, wherein said spring is formed of a spring-elastic piece of steel wire which is substantially rectilinear in unstressed state.

17. Over-center hinge according to claim 15, wherein said spring is formed by a flat spring of spring steel which is slightly curved in unstressed state.

18. Over-center hinge according to any one of claims 15 to 17, wherein two parallel, rod-like, directly adjacent springs in contact with the cam are provided in the recess in the fastening flange.

19. Over-center hinge according to claim 18, wherein said two springs are disposed perpendicularly one over the other in the recess with respect to the inside surface of the door.

20. Over-center hinge according to claim 18, wherein said two springs are disposed in the recess side by side with flat sides thereof, with respect to the inside surface of the door.

* * * * *